US006032455A

United States Patent [19]

Reimann

[11] Patent Number: 6,032,455

[45] Date of Patent: Mar. 7, 2000

[54] DEVICE TO HOLD ROLLER CHAIN

[76] Inventor: Richard Reimann, 3928A 14th St. NW., Garrison, N. Dak. 58540

[21] Appl. No.: 09/335,486

[22] Filed: Jun. 18, 1999

[51] Int. Cl.[7] ..... B21L 21/00

[52] U.S. Cl. ..... 59/7; 59/11

[58] Field of Search ..... 59/7, 11

[56] References Cited

U.S. PATENT DOCUMENTS

| | | | |
|---|---|---|---|
| 1,710,092 | 4/1929 | Hitchcock . | |
| 1,994,270 | 3/1935 | Cetrano . | |
| 2,332,607 | 10/1943 | Schroeder et al. | 59/7 |
| 3,379,005 | 4/1968 | Jones . | |
| 4,157,594 | 6/1979 | Raabe | 59/7 |
| 4,394,810 | 7/1983 | Womble . | |
| 4,429,525 | 2/1984 | Doak . | |
| 5,056,305 | 10/1991 | Cole . | |
| 5,193,336 | 3/1993 | King . | |
| 5,752,377 | 5/1998 | Small | 59/7 |
| 5,899,125 | 5/1999 | Hegemier | 59/7 |

FOREIGN PATENT DOCUMENTS 171020 11/1921 United Kingdom .

*Primary Examiner*—David Jones
*Attorney, Agent, or Firm*—Richard C. Litman

[57] ABSTRACT

A device to hold roller chain is disclosed for holding roller chain in position for repair, maintenance, and the like. The device includes first and second jaws which are generally parallel. Each jaw has first and second ends, inner and outer faces, and two side faces. Each of the jaws has a primary gripping recess in the inner face near one end to grip the roller chain. Each jaw may also have a secondary gripping recess at the opposite end of the jaw. First and second shank members extend between the jaws and through at least one of the jaws. Each shank member has a cylindrical shank with external threads. The device has two shank channels, with each shank channel extending from the inner to the outer face of one of the jaws. The shanks pass through the shank channels. A pair of nut members engage the threads of the shanks adjacent to the outer faces. A coil spring surrounds each shank between the first and second jaws and biases the jaws away from each other. The shank members and nut members allow the jaws to be adjusted to grip the roller chain, while the coil springs keep the device stable.

16 Claims, 4 Drawing Sheets

DEVICE TO HOLD ROLLER CHAIN

BACKGROUND OF THE INVENTION

1. Field of the Invention

The present invention relates generally to roller chains, and specifically to devices for holding roller chain in position for repair.

2. Description of the Related Art

Roller drive chains for bicycles, motorcycles, and other machines are well known to be awkward to repair. Such chains occasionally must be shortened to maintain the proper operating tension. Links can also become damaged and must be replaced. Very heavy chains, such as those used with tractors and other heavy machinery, are particularly difficult to handle during repairs and maintenance.

When a damaged chain link must be replaced, it is desirable to repair the chain without removing it from its sprockets. This assures the correct length, alignment, and tension. The difficult and dirty job of removing and replacing the chain is also avoided by leaving the chain in place.

A number of devices are known for maintaining the links of a roller chain in alignment for repair. Known devices have a number of disadvantages. Some devices are held in the hand and use hand pressure to tighten the chain, leaving only one hand to work on the chain. Other devices are expensive, heavy, or awkward to work with. No device is known which is simple and inexpensive, adjusts easily, fits into tight spaces, and holds the chain firmly and taut in the right position. The following patents illustrate devices having these disadvantages.

U.S. Pat. No. 1,710,092 to Hitchcock discloses a chain repair tool for heavy chains which includes a primary finger, a secondary finger, a nut, a bevel gear, and a lever. A spring holds the teeth of the bevel gear in engagement with the nut. The chain is held by the fingers and a ratchet brings the end links together to place a coupling pin. The ratchet is then reset to the operate in the opposite direction and spread the fingers apart. The spring is not located between the fingers and does not act to bias the fingers apart.

U.S. Pat. No. 1,994,270 to Cetrano teaches a tool for use in repairing sprocket chains. The tool has a pair of chain couplers, of which one is slidable toward the other along a straight bar which penetrates the couplers. A pair of hand-levers moves the couplers toward each other.

U.S. Pat. No. 3,379,005 to Jones discloses a chain clamp having engaging jaws with hooks to engage the chain. The jaws move on a threaded bolt shank.

U.S. Pat. No. 4,394,810 to Womble teaches a chain link repair device for metal drive chains, combining a vise and a breaker pin. The two jaw-heads of the vise pull the links together with the correct tension. The two jaw-heads are connected by guide rods and an actuator bolt. The breaker pin facilitates removal of the center bearing pin in large chain drive links.

U.S. Pat. No 5,056,305 to Cole discloses a tool for separating chain links which has an elongated lead screw having a threaded shaft manually turned by finger lever or wrench nut. One jaw member is pivotally connected to a support member, while the other jaw member is pivotally connected to a travelling nut engaged with the lead screw. The jaws are coupled in scissors fashion.

U.S. Pat. No. 5,193,336 to King teaches a tool for removing a clip member from a master link an a chain member. The tool has a first plier jaw pivotally secured to a second plier jaw. Each plier jaw has a first and a second arcuate recess to hold the roller chain.

British Patent 171,020 discloses a chain rivet extractor in which the chain link is gripped between a pair of jaws. The jaws are attached to holders which project above and below the jaws. The jaws are connected by toggle links. A screwed stem moves the toggle links so that the jaws grip the chain link. A spring may be attached to the jaws in such a manner as to tend to close them. The springs are not located between the jaws and do not act to bias the jaws apart.

None of the above inventions and patents, taken either singularly or in combination, is seen to describe the instant invention as claimed. Thus a device to hold roller chain solving the aforementioned problems is desired.

SUMMARY OF THE INVENTION

The present invention is a roller chain device for holding roller chain in position for repair, maintenance, and the like. The device includes first and second jaws which are generally parallel. Each jaw has first and second ends, inner and outer faces, and two side faces. Each of the jaws has a primary gripping recess in the inner face near one end to grip the roller chain. Each jaw may also have a secondary gripping recess at the opposite end of the jaw. First and second shank members extend between the jaws and through at least one of the jaws. Each shank member has a cylindrical shank with external threads. The device has two shank channels, with each shank channel extending from the inner to the outer face of one of the jaws. The shanks pass through the shank channels. A pair of nut members engage the threads of the shanks adjacent to the outer faces. A coil spring surrounds each shank between the first and second jaws and biases the jaws away from each other. The shank members and nut members allow the jaws to be adjusted to grip the roller chain, while the coil springs keep the device stable.

Accordingly, it is a principal object of the invention to provide a device for holding roller chains having first and second jaws, first and second shank members, two shank channels, two nut members, and two coil springs.

It is another object of the invention to provide a device for holding roller chain having coil springs surrounding the shanks of the shank members and biasing the jaws apart.

It is a further object of the invention to provide a roller chain device which holds roller chains taut in the correct position.

Still another object of the invention is to provide a roller chain device which is lightweight, easy to use, and fits into tight spaces.

Another object of the invention is to provide a roller chain device which allows roller chains to be repaired or adjusted without removing them from their sprockets.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
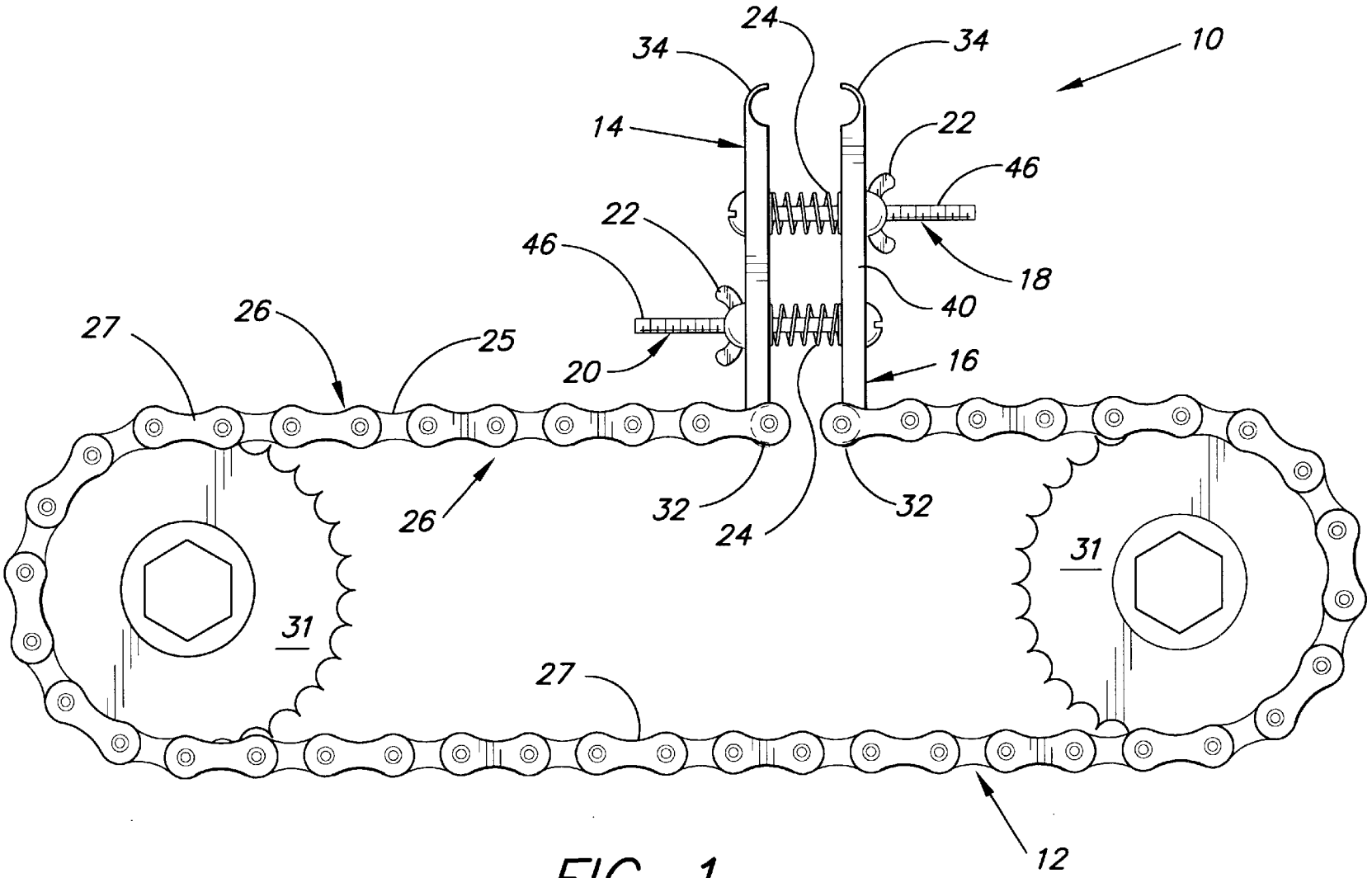
FIG. 1 is an environmental, side view of a roller chain device holding a roller drive chain in position for replacing a link.

The present invention is a roller chain device 10 for holding a roller chain 12 in position for repair, maintenance, and the like. The device 10 includes first and second jaws 14 and 16 generally parallel to each other. First and second shank members 18 and 20 extend between the jaws. The device also has a pair of nut members 22 and a pair of coil springs 24.

The roller chain 12 is of conventional design. The roller chain has a number of overlapping link pairs 26. Each link pair 26 has a roller link 25 and a master link 27. The links are connected by pins 28. Each roller link 25 has a pair of rollers 30. The rollers 30 engage with the sprocket 31. See FIGS. 1 and 5.

The device 10 may be used with any type of roller chain, including bicycle chains. The roller chain device is particularly useful with chains which are large, heavy, or difficult to replace on their sprockets. Examples include roller drive chains in motorcycles, industrial machinery, construction equipment, and farming equipment such as combines and swathers.

Each of the jaws 14 and 16 is elongated in shape. Preferably the jaws are composed of steel, although other metals and alloys suitable for toolmaking may be used. Most preferably the steel is key stock. A hacksaw may be used to cut the key stock to the appropriate lengths.

Figure 4:
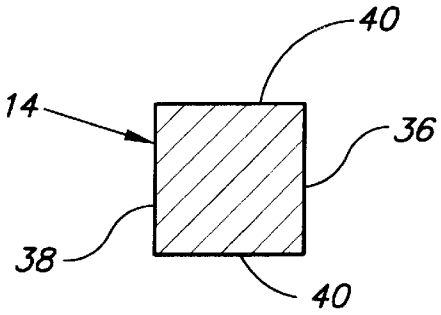
FIG. 4 is a cross-sectional, detail view of a jaw, taken along line 4—4 of FIG. 3.
Figure 3:
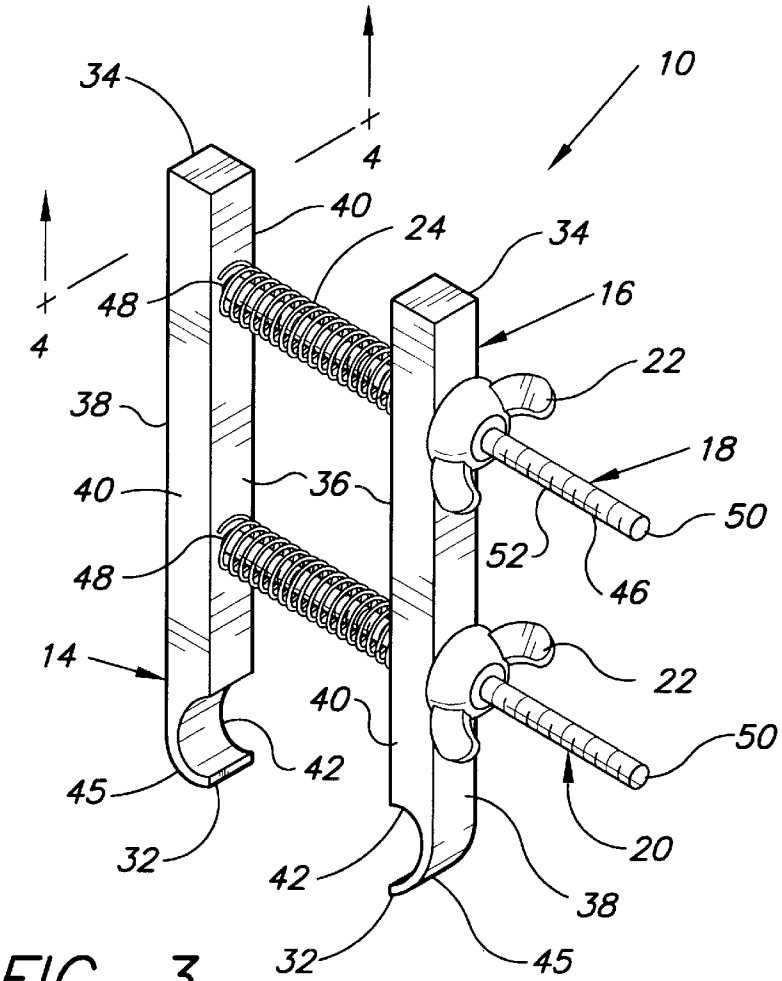
FIG. 3 is a perspective view of a roller chain device having integrally attached shank members.

Each jaw has a first end 32 and a second end 34. Each jaw has an inner face 36, an opposite outer face 38, and two side faces 40. Preferably the width of the inner, outer, and side faces of each jaw are equal or approximately equal, as shown in FIGS. 3 and 4. The jaw is therefore square in a cross-section perpendicular to the longitudinal axis of the jaw. The width of each of the inner, outer, and side faces preferably is uniform from the first end to the second end of the jaw. This simplifies the manufacture of the device.

The width of each face preferably is equal to or slightly less than the length of the rollers 30 of the roller chain. This allows the jaw to fit neatly into the roller chain with a minimum of play. For #10–#20 roller chain, key stock which is ¼ inch square is suitable.

The jaws 14 and 16 are generally parallel to each other. The inner faces 36 are near each other and face each other in a mirror image configuration. The outer faces 38 face away from each other. The first and second ends 32 and 34 of the first jaw 14 are located near the first and second ends 32 and 34 respectively of the second jaw 16 in a mirror image configuration.

The jaws are held generally parallel by the shank members and the nut members. The jaws are not held precisely parallel to each other, as in typical vise configurations. Rather, the jaws have a small amount of play. The play allows the jaws to diverge from being precisely parallel by an angle of about 5 to about 15 degrees, preferably about 10 degrees. This arrangement makes the device easier to manufacture and easier to use.

The length of the jaws extends from the first end 32 to the second end 34. The preferred length for a double-ended device is about 3 to 4 times the length of a link pair. See FIGS. 1 and 5. A single-ended device, such as in FIG. 3, may be somewhat shorter; 2 to 3 times the length of a link pair is preferred. These lengths provide sufficient room for the proper separation of the shank members 18 and 20, while keeping the overall length as short as possible. If the jaws are too long, the device is less able to fit into tight spaces and more difficult to carry. Key stock having a length of about 2 inches is preferred for #10–#20 roller chain.

Figure 2:
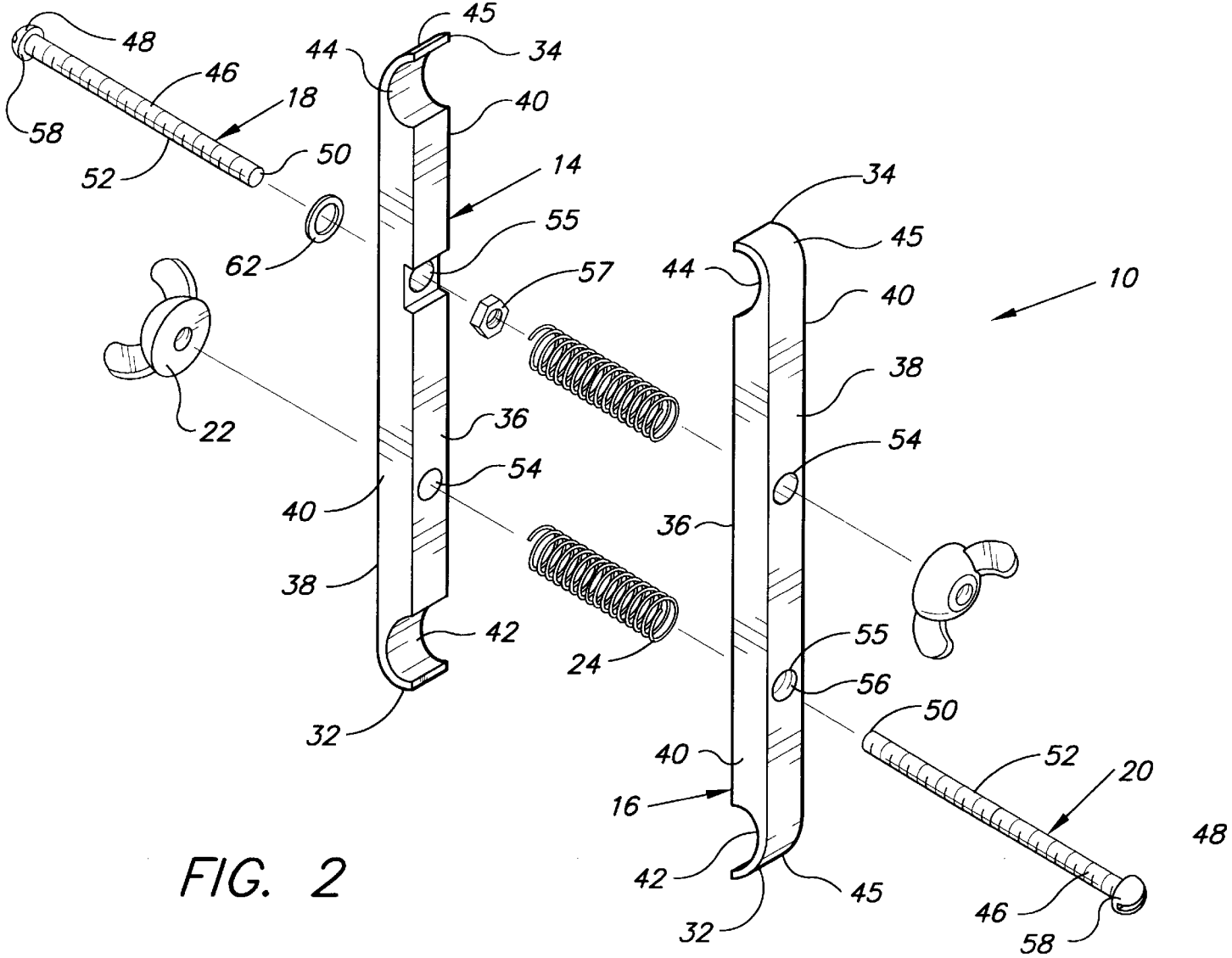
FIG. 2 is an exploded, perspective view of a roller chain device having primary and secondary gripping recesses.
Figure 5:
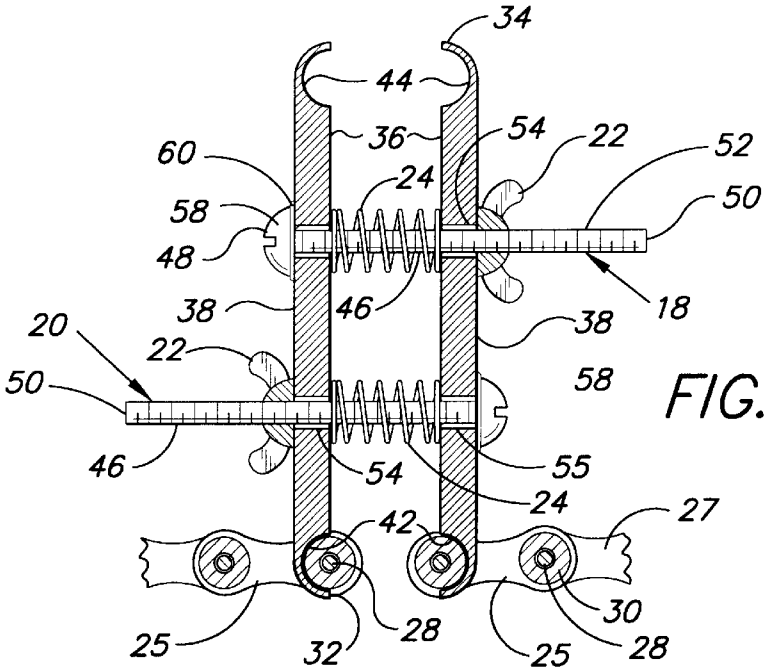
FIG. 5 is a fragmented, side view of a roller chain device in place on a roller chain, showing the jaws and roller chain in cross-section.

Each jaw 14 or 16 has a primary gripping recess 42 in the inner face 36. The primary gripping recess of each jaw is located at a uniform distance from the first end 32 of the jaw. The primary gripping recesses are directly opposite each other and face each other. Each primary gripping recess 42 is semicylindrical or generally semicylindrical, as shown in FIGS. 2, 3, and 5. In cross section each primary gripping recess is preferably a complete or nearly complete half-circle. This provides a secure fit, even if the jaws are not precisely parallel to the roller chain or to each other. Exact alignment is not required.

The primary gripping recesses of each jaw have an equal or approximately equal radius. In the preferred embodiment the primary gripping recesses of each jaw are mirror images of each other.

For optimal fit, the radius of the primary gripping recess is equal to or slightly larger than the external radius of the roller. This configuration allows the primary gripping recesses to engage the rollers 30 securely with a minimum of play. See FIG. 5. A radius for the gripping recesses of no more than 1¼ times the external radius of the rollers is preferred. However, a radius of 1½ times the radius of the roller is acceptable. A jaw having a primary gripping recess larger than this is likely to have too much play for a secure fit. In addition, the jaw may be too bulky to fit easily between the rollers 30.

In a preferred embodiment, each of the jaws has a secondary gripping recess 44 in the inner face 36. Each secondary gripping recess 44 is located at a uniform distance from each second end 34, with the secondary gripping recesses being mirror images of each other. Each of the secondary gripping recesses has an approximately equal radius. In the double-ended device the radius of the primary gripping recesses preferably is different from the radius of the secondary gripping recesses. Ideally each end is configured to fit a different size chain, giving the device extra flexibility. In other respects the secondary gripping recesses are similar to the primary gripping recesses. Each secondary gripping recess is generally semicylindrical and adapted to engage the rollers 30 of the roller chain.

The first end of each jaw has an outer surface 45 near the outer face 38. Preferably each outer surface 45 of each first end is arcuate. The first end of each jaw is therefore hook-shaped in a cross section parallel to the longitudinal axis of the jaw. The smooth hook shape allows the end of the jaw to fit easily between the rollers without damaging the rollers. See FIGS. 2, 3, and 5. For a double-ended device, the second end 34 of each jaw also ideally has an arcuate outer surface 45 near the outer face 38. The second end of each jaw is also hook-shaped in cross section, as shown in FIG. 5. For a single-ended device, as in FIG. 3, the second end 34 is preferably flat. The flat end may be polished with a sander, if desired.

The first and second shank members 18 and 20 each have a cylindrical shank 46, an attachment end 48, and a free end 50. Each shank 46 has external threads 52, diagrammatically shown in FIGS. 2–5. Preferably the entire length of the shank is threaded, as shown in FIG. 2. However, a part of the shank near the attachment end 48 and/or the free end 50 may be left unthreaded if desired.

Each of the shank members is located near one of the ends 32 or 34 of the jaw. If the end of the jaw has a gripping recess, the shank member is located between the gripping recess and the center of the jaw. The shank members are separated from any gripping recesses by a distance large enough to avoid interference with attachment to the roller chain. When the roller chain is gripped by the gripping recesses, the nut members have sufficient clearance to be easily turned by the fingers of the user. Preferably the adjacent shank member is separated from the gripping recess by about one to two times the radius of the gripping recess. For a single-ended device, such as in FIG. 3, the shank member near the second end 34 is preferably separated from the second end 34 by one to two times the width of the inner face 36.

Each shank 46 extends between the first and second jaws generally perpendicular to the inner face 36 of each jaw. The shanks are generally parallel to each other. The attachment end 48 of the first shank member 18 attaches to the first jaw 14. The attachment end 48 of the second shank member 20 may attach to the first jaw, as shown in FIG. 3. This version is somewhat easier to manufacture when the shank members are integrally molded with the jaw.

In a preferred embodiment, the attachment end 48 of the second shank member 20 attaches to the second jaw 16. See FIGS. 1, 2, 5, and 6. The reciprocal arrangement of the shank members makes the device easier to manipulate and position on the roller chain. Both nut members 22 can be adjusted simultaneously. The device can be fitted more quickly to the roller chain and also removed quickly.

Preferably the device 10 has exactly two shank members 18 and 20. Additional shank members complicate the manufacture and the operation of the device, and do not improve the functionality.

Each shank member preferably has a length ranging from about 1½ times to about 3 times the length of one link pair of the roller chain. The most preferred length is about 2 times the length of a link pair. A shank member which is too short may not allow the jaws to open sufficientLy wide to accommodate the roller chain, particularly if two or more adjacent links require repair. However, if the shank members are too long, the device may be overly bulky and awkward to carry.

The separation between the shank members 18 and 20 preferably ranges from about the length of one link to about the length of three links. A preferred separation is about the length of one link pair (or two links). Too large a separation tends to either place the shank members too close to the gripping recesses, or make the overall length of the jaws too long. For #10–#20 roller chain, the preferred separation is about one inch.

The device 10 also has a pair of shank channels 54, as shown in FIGS. 2 and 5. Each shank channel 54 is cylindrical and extends from the inner face to the outer face of one of the jaws. Each shank 46 passes through one of the shank channels 54. In the preferred embodiment having a reciprocal arrangement of shank members, the shanks of the first and second shank members pass through the shank channels of the second and first jaws respectively.

In an alternative embodiment, the second jaw 16 has two shank channels 54. See FIG. 3. In this embodiment, the attachment ends 48 of both the first and second shank members 18 and 20 attach to the first jaw. Each shank 46 passes through one of the shank channels of the second jaw 16. The attachment ends of each of the first and second shank members may be integrally attached to the first jaw 14, as shown in FIG. 3. This arrangement allows both shank members to be molded in one piece with the first jaw.

The shank channels 54 are slightly larger in diameter than the shanks 46. See FIG. 5. Preferably the shank channels have a smooth inner surface, as shown in FIG. 5. Preferably the diameter of the shank channels is less than 1¼ the diameter of the shanks. Each shank channel is located directly opposite the attachment end of the corresponding shank member. The axis of the shank channel is perpendicular to the inner and outer faces of the jaw and parallel to the shank. The shank therefore moves easily through the shank channel without binding as the jaws move toward and away from each other.

The diameter of the shank channels is preferably large enough to allow the jaws about 5 to 15 degrees of play in each direction, most preferably about 10 degrees of play or less. Too much play makes the grip of the device unstable. A shank channel having a smooth inner surface adjacent to the threaded exterior of the shank allows a suitable amount of play. The shank channels may be drilled in the jaws using a press drill and milling table. For a #10–#20 roller chain, a ¼ inch drill bit may be used.

A shank channel having a smooth inner surface is inexpensive to manufacture. Many prior art vise devices have a screw with exterior threads engaging a set of interior threads. This requires precise matching between the mating threads, which increases manufacturing expense. Such mating threads are also prone to binding if either set of threads is damaged or if debris gets into the threads. Eliminating the need for mating threads reduces the cost of the roller chain device. Durability is also improved.

Each of the pair of nut members 22 has internal threads 56, diagrammatically shown in FIG. 2. The nut members are of conventional design. The internal threads 56 of each nut member engage the external threads 52 of one of the shanks 46. Each nut member 22 is located adjacent to one of the outer faces 38. See FIGS. 1–3, 5, and 6.

The nut members preferably are turned by hand; this eliminates the need for a separate wrench to adjust the distance between the jaws. Most preferably the nut members are wing nuts, as shown in FIGS. 1–3 and 5–6. Thumbscrews or other hand-turned nut members may also be used ordinary nuts such as hexagonal nuts may be used where clearance between the gripping recesses and the shank members is limited and a suitable wrench is readily available. For #10–#20 roller chain, a 0.5/32" wing nut is suitable.

Each of the pair of coil springs 24 is located between the inner faces of the first and second jaws 14 and 16. The springs 24 bias the first and second jaws away from each other. Each coil spring 24 surrounds one of the shanks 46 between the jaws. For #10–#20 roller chain, a 3/41" length× 15/64" spring is suitable. The ends of each spring contact the inner faces 36 of each jaw. If desired, a nut or washer 57 may be located between the end of the spring and the jaw. The outer face 38 may have a notch 59 to accommodate the nut 57. See FIG. 2.

The configuration of the shank members, shank channels, springs, and nut members makes the roller chain device 10 easy to use. The nut members 22 act in opposition to the springs 24, allowing dynamic adjustment of the distance between the jaws. The nut members may be adjusted simultaneously or separately. For example, the distance between both jaws may be initially set to the approximate distance to be spanned. This initial adjustment can be made quickly, since precision is not required. One of the rollers is then placed in a gripping recess. The nut member furthest from the roller chain may then generally be left undisturbed, while fine adjustments are made with the nut member closest to the roller chain. For example, the distance may be widened slightly with the closer nut member to allow the gripping recess of the other jaw to slip over the appropriate roller. The closer nut member is then tightened again to grip the roller. After the repair is finished, the closer nut member may be turned to release the rollers.

In another preferred embodiment, the shank members 18 and 20 are bolts. The bolts are conventional in construction. The attachment end 48 of each shank member has a head 58, as conventional for a bolt. See FIGS. 1, 2, 5, and 6. For #10–#20 roller chain, a 5/32×2" bolt is suitable.

In the most preferred embodiment, each of the first and second jaws has a bolt head channel 55, as shown in FIG. 5. Each bolt head channel 55 extends from the inner face 36 to the outer face 38 of the corresponding jaw, perpendicular to the inner face. Each bolt head channel is cylindrical. The heads 58 of the first and second shank members are near the outer faces 38 of the first and second jaws respectively. Each shank 46 passes through one of the bolt head channels 55.

The head 58 of each shank member is preferably secured in some way to the outer face 38 or the bolt head channel 55, to prevent or limit the bolt turning when the nut member 22 is turned. An adhesive 60 between the head 58 and the outer face 38 may be used to secure the bolt, as in FIG. 5.

Alternatively, the bolt head channels 55 may have internal threads to limit the head 58 from turning. The internal threads are shown diagrammatically for bolt head channel 55 of jaw 16 in FIG. 2. The external threads of each shank 46 engage the internal threads of the bolt head channel 55 through which the shank passes, securing the bolt. A washer 62 may be used between the head and the outer face. The washer 62 is preferably a star washer, but any suitable washer may be used.

Preferably at least one of the channels through which each bolt passes (either the shank channel 54 or the bolt head channel 55) is unthreaded, to allow for play between the jaws. If the shank channel is threaded to engage the shank, the bolt head channel is preferably unthreaded. Similarly, if the bolt head channel is threaded, the shank channel is preferably unthreaded. Both channels 54 and 55 may be unthreaded, to limit manufacturing costs for the jaws.

Using a bolt instead of an integrally molded shank member has several advantages. The jaws can be formed from simple steel key stock, and do not require a complicated molding process. The required channels for the bolt are easily drilled through each jaw. The two jaws may be exact duplicates of one another, limiting the number of required parts. If the threads of a bolt are damaged, the bolt is easily replaced without requiring replacement of the entire device 10. Since the bolt can be replaced, a relatively lightweight bolt can be used, which reduces the weight of the device overall.

The jaws may be generally straight from the first end 32 to the second end 34. See FIGS. 1–3 and 5. This configuration has the advantage of being simple and inexpensive to manufacture. Straight jaws also make the roller chain device relatively flat and easy to carry in a pocket or a toolbox. However, the jaws of such a device may be too long to fit easily into tight spaces around a roller chain. This is particularly true for double-ended devices, which are longer than the single-ended devices.

Figure 6:
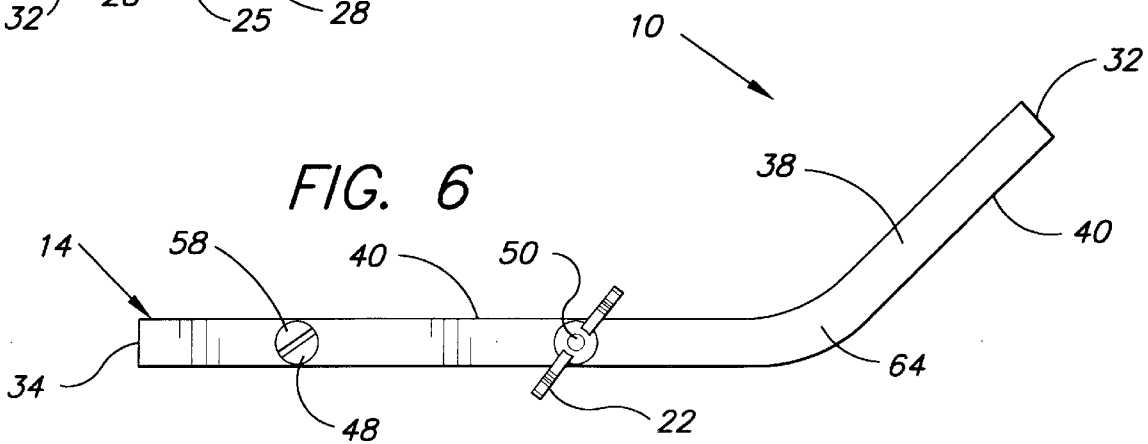
FIG. 6 is a side view of a roller chain device having the first and second ends at an angle to each other.

FIG. 6 is a side view of an alternative double-ended embodiment in which the second end 34 of each of the first and second jaws 14 and 16 is located at an angle to the first end 32 of the corresponding jaw. The jaws are generally parallel to each other throughout their length, just as for the straight jaw configuration. The angle is the same for both jaws. The angled configuration provides added flexibility in that each end may fit a different size of roller chain, while the angle allows each end to fit into tight spaces. Both shank members may be on the same side of the bend 64, as in FIG. 6. Alternatively, the bend 64 may be located between the shank members.

The angle between the first and second ends 32 and 34 preferably ranges from about 30 degrees to about 90 degrees. Most preferably the angle is about 45 degrees. This angle is large enough to provide a good fit in tight spaces and small enough to minimize the bulk of the device 10.

The roller chain device 10 holds the roller chain taut and in position on the sprockets 31. A damaged link may be removed simply by gripping the rollers of the links on either side of the damaged link. The damaged link can be removed and replaced, while the chain remains in place on the sprockets. A master link or half link can be easily inserted. Since the roller chain device holds the roller chain securely, both hands can be used to remove and replace the needed links. The device 10 is sufficiently lightweight to support itself on the chain. The user does not have to hold one end of the chain in one hand while using the other hand to replace the link. The user also does not have to use one hand to hold the roller chain device, as is true for the plier-type devices found in the prior art. For large chains, the job can be performed by a single person, instead of requiring an additional person to hold the links in the proper position.

It is to be understood that the present invention is not limited to the embodiments described above, but encompasses any and all embodiments within the scope of the following claims.

I claim:

1. A device to hold a roller chain, the roller chain having rollers, the device comprising:

first and second jaws, each jaw being elongated, each jaw having a first end, a second end, an inner face, an opposite outer face, and two side faces, the jaws being generally parallel to each other, the inner face and the first and second ends of the first jaw being located near the inner face and the first and second ends respectively of the second jaw, each jaw having a primary gripping recess in the inner face at a uniform distance from each first end, each primary gripping recess being generally semicylindrical and adapted to engage the rollers of the roller chain, each of the primary gripping recesses having an approximately equal radius;

first and second shank members, each shank member having a shank, an attachment end, and a free end, each shank being cylindrical and having external threads, the attachment end of the first shank member attaching to the first jaw, the attachment end of the second shank member attaching to one of the first and second jaws, each shank extending between the first and second jaws generally perpendicular to the inner face of each jaw;

two shank channels, each shank channel being cylindrical and extending from the inner face to the outer face of one of the first and second jaws, the shank of each shank member passing through one of the shank channels opposite the attachment end of the corresponding shank member;

two nut members, each nut member having internal threads, the internal threads of each nut member engaging the external threads of one of the shanks, each nut member being located adjacent to one of the outer faces; and two coil springs, each coil spring being located between the inner faces of the first and second jaws and biasing the first and second jaws away from each other, each coil spring surrounding one of the shanks.

2. The device according to claim 1, in which each of the first and second jaws has a shank channel, the attachment end of the second shank member attaches to the second jaw, and the shanks of the first and second shank members pass through the shank channels of the second and first jaws respectively.

3. The device according to claim 1, in which the second jaw has two shank channels, the attachment end of the second shank member attaches to the first jaw, and each shank passes through one of the shank channels of the second jaw.

4. The device according to claim 1, in which each nut member is a wing nut.

5. The device according to claim 1, in which each of the first and second jaws has a bolt head channel, each bolt head channel extends from the inner face to the outer face of the corresponding jaw perpendicular to the inner face, each bolt head channel is cylindrical, each of the first and second shank members is a bolt, the attachment end of each shank member has a head, the heads of the first and second shank members are near the outer faces of the first and second jaws respectively, and each shank passes through one of the bolt head channels.

6. The device according to claim 5, in which each bolt head channel has internal threads, and the external threads of each shank engage the internal threads of the bolt head channel through which the shank passes.

7. The device according to claim 1, in which each shank channel has a smooth inner surface.

8. The device according to claim 1, in which the attachment ends of each of the first and second shank members are integrally attached to one of the first and second jaws.

9. The device according to claim 1, in which the first end of each of the first and second jaws has an outer surface near the outer face, and the outer surface of each first end is arcuate, so that the first end of each jaw is hook-shaped in cross section.

10. The device according to claim 1, in which the width of the inner, outer, and side faces of each of the first and second jaws is approximately equal.

11. The device according to claim 1, in which each jaw is generally straight from the first end to the second end.

12. The device according to claim 1, in which each of the first and second jaws has a secondary gripping recess in the inner face at a uniform distance from each second end, each secondary gripping recess is generally semicylindrical and adapted to engage the rollers of the roller chain, and each of the secondary gripping recesses has an approximately equal radius.

13. The device according to claim 12, in which the second end of each of the first and second jaws has an outer surface near the outer face, and the outer surface of each second end is arcuate, so that the second end of each jaw is hook-shaped in cross section.

14. The device according to claim 12, in which the second end of each of the first and second jaws is located at an angle to the first end of the corresponding jaw.

15. The device according to claim 14, in which the angle ranges from about 30 degrees to about 90 degrees.

16. The device according to claim 15, in which the angle is about 45 degrees.

* * * * *